US007628148B2

(12) United States Patent
Lian

(10) Patent No.: US 7,628,148 B2
(45) Date of Patent: Dec. 8, 2009

(54) SHOOTING MECHANISM FOR PAINT BALL GUN

(75) Inventor: Sheng-Jen Lian, Taichung County (TW)

(73) Assignee: Yao-Gwo Gan, Taichung (TW)

( * ) Notice: Subject to any disclaimer, the term of this patent is extended or adjusted under 35 U.S.C. 154(b) by 0 days.

(21) Appl. No.: 12/081,052

(22) Filed: Apr. 10, 2008

(65) Prior Publication Data

US 2009/0255523 A1 Oct. 15, 2009

(51) Int. Cl.
*F41B 11/32* (2006.01)

(52) U.S. Cl. ..... 124/73

(58) Field of Classification Search ..... 124/73–76
See application file for complete search history.

(56) References Cited

U.S. PATENT DOCUMENTS 6,553,983 B1 * 4/2003 Li ..... 124/73
2006/0037597 A1 * 2/2006 Wood ..... 124/73

* cited by examiner

*Primary Examiner*—Stephen M Johnson
*Assistant Examiner*—Reginald Tillman, Jr.
(74) *Attorney, Agent, or Firm*—Banger Shia

(57) ABSTRACT

A shooting mechanism of a paint ball gun includes a valve located in the air tube of the gun and the valve is composed of a first member and a second member. A piston rod movably extends through the valve. The first member includes a shoulder extends radially and inward from an inner periphery of the first member. An aperture is defined in communication between the shoot tube located above the air tube and the first member. A piston head is connected to an end of the piston rod and removably seals the space, the other end of the piston rod is hit the strike rod. A flange extends radially outward from the piston rod and located between the shoulder and an inner end of the second member. The flange can be stopped by the shoulder of the first member when the piston rod is hit by the strike rod.

6 Claims, 6 Drawing Sheets

SHOOTING MECHANISM FOR PAINT BALL GUN

BACKGROUND OF THE INVENTION (1) Field of the Invention

The present invention relates to a shooting mechanism for paint ball gun and the piston rod of the valve in the gun does not generate much vibration when shooting.

(2) Description of the Prior Art

A conventional paint ball gun includes a valve which includes a piston rod which controls the communication of the valve and the chamber in the barrel of the gun. The piston rod is hit by a strike rod so as to open the valve to introduce pressurized air into the barrel to shoot the pain ball. The piston rod is applied by the pressurized air in a direction opposite to the direction that the piston rod is hit and moved, so that the strike rod has to hit the piston rod hard enough to overcome the force applied to the piston rod and this generates a significant reaction force to the gun. How to reduce the reaction force is one of the most concerns of a satisfied pain ball gun.

US 2006003759 discloses an improved design wherein the piston rod includes an enlarged portion which defines a small chamber in the valve and the chamber is communicates with a main chamber from which the pressurized air is stored. The pressurized air in the main chamber provides limited air to the small chamber so as to assist the movement of the piston rod when the piston rod is hit by the strike rod. By this way, the strike rod does not need to apply that much of force to move the piston rod, so that the reaction force applied to the user's hand can be reduced. However, when the piston rod is hit by the strike rod, a certain part of the piston rod extends out from the valve and that part does not have any support or positioning means to hold. When the piston rod is pulled back, that part might not be able to smoothly moves back to its original position.

The present invention intends to provide a shooting mechanism for a paint ball gun wherein the valve includes a shoulder which prevents the piston rod from extending too much from the valve after being hit by the strike rod.

SUMMARY OF THE INVENTION

The present invention relates to a paint ball gun that comprises a handle connected with a main which includes an air tube connected with the handle and a shoot tube located parallel to the air tube. A communication hole is defined in communication between the shoot tube and the air tube. A push member is movably located in the shoot tube so as to push paint balls out from the shoot tube. A strike rod is movably received in a rear end of the air tube and connected with the push member. A first chamber is defined in a front end of the air tube and pressurized air is provided into the first chamber from a pressurized source. A valve is located in the air tube and includes a first member and a second member is threadedly connected to an end of the first member. A piston rod movably extends through the valve. The first member includes a space defined therein and a shoulder extends radially and inward from an inner periphery of the first member. An aperture is defined through a wall of the first member and in communication between the shoot tube and the space. Two ends of the piston rod extend out from the first and second members respectively. A piston head is connected to an end of the piston rod and removably contacts an end of the first member so as to seal the space. The other end of the piston rod extends out from the second member and faces the strike rod. A flange extends radially outward from the piston rod and is located between the shoulder and an inner end of the second member. A second chamber is defined between the flange and the inner end of the second member. a path is defined axially in the piston rod and communicates with the piston head so as to introduce pressurized air from the first chamber into the second chamber. The flange is stopped by the shoulder of the first member when the position rod is hit by the strike rod.

The primary object of the present invention is to provide a shooting mechanism wherein the piston rod is stopped by the shoulder in the valve so that the piston rod does not overly protrude from the valve when shooting.

Another object of the present invention is to provide a shooting mechanism wherein the movement of the piston rod is steady and does not shake due to the contact between the shoulder in the valve and the flange of the piston rod.

Yet another object of the present invention is to provide a shooting mechanism wherein the second member of the valve includes radial holes and grooves to release the air in the second member of the valve when the piston rod moves back to its original position.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
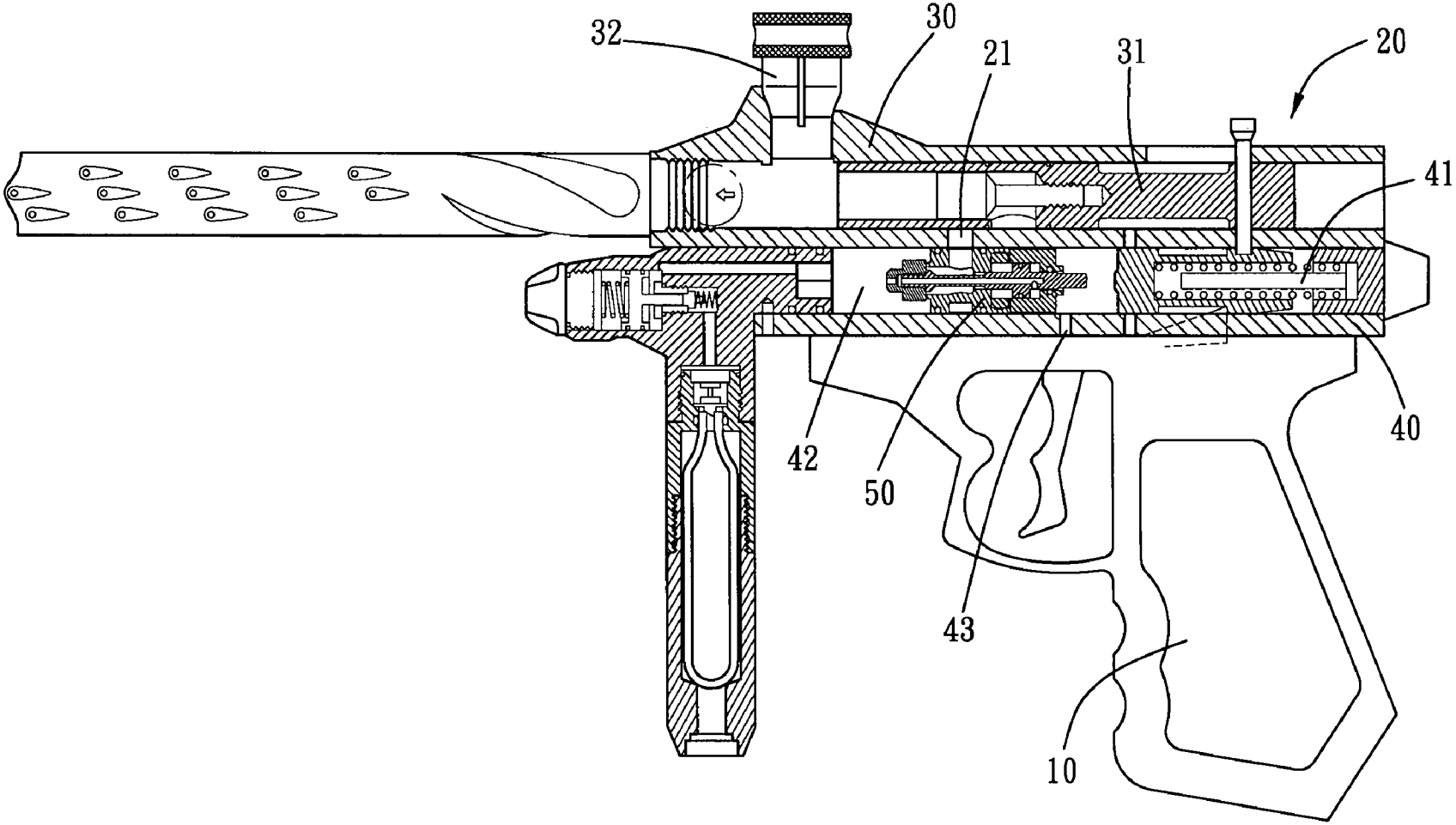
FIG. 1 is a cross sectional view of the paint ball gun to show the shooting mechanism of the present invention.
Figure 2:
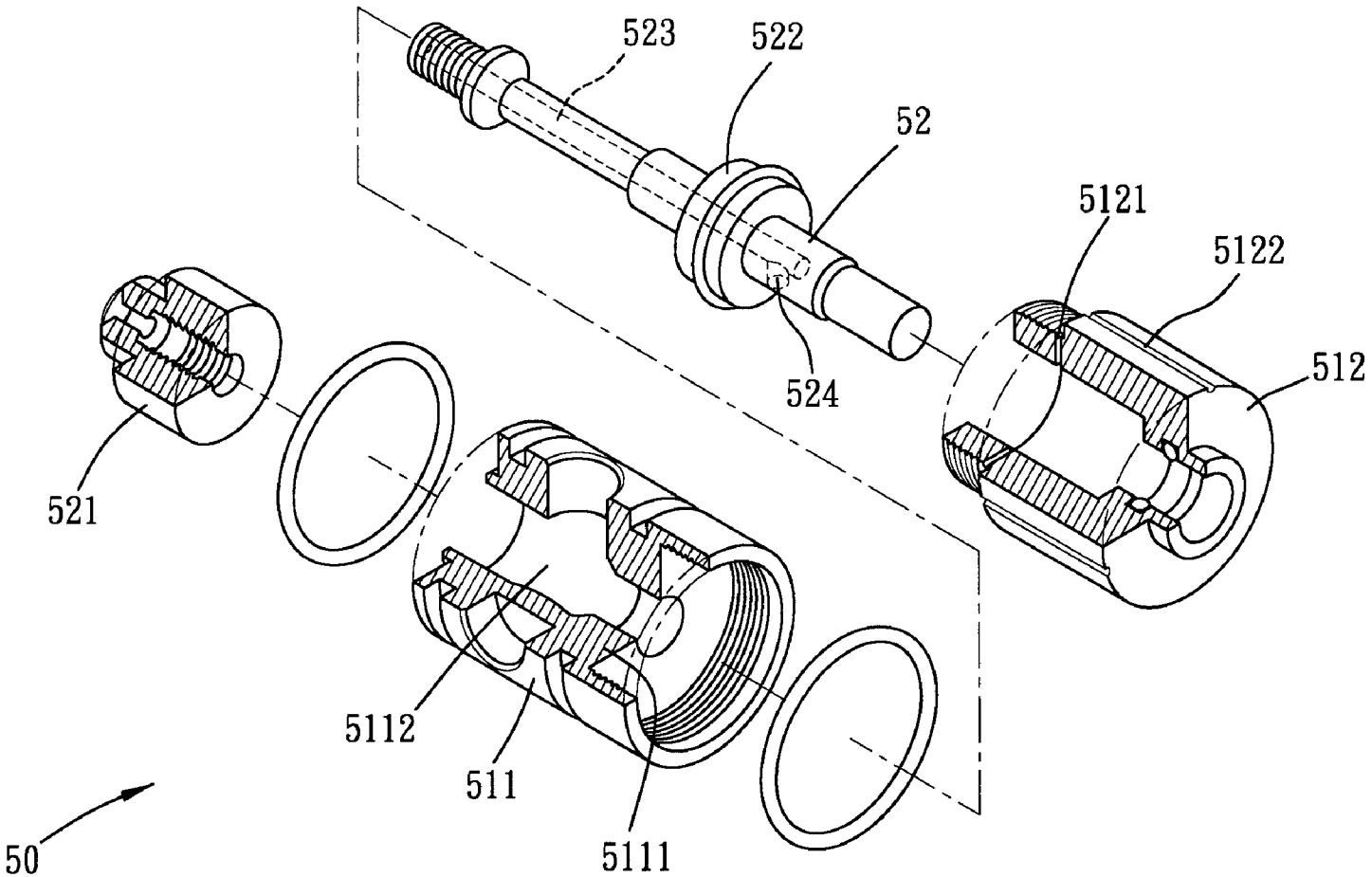
FIG. 2 is an exploded view to show the valve of the shooting mechanism of the present invention.
Figure 3:
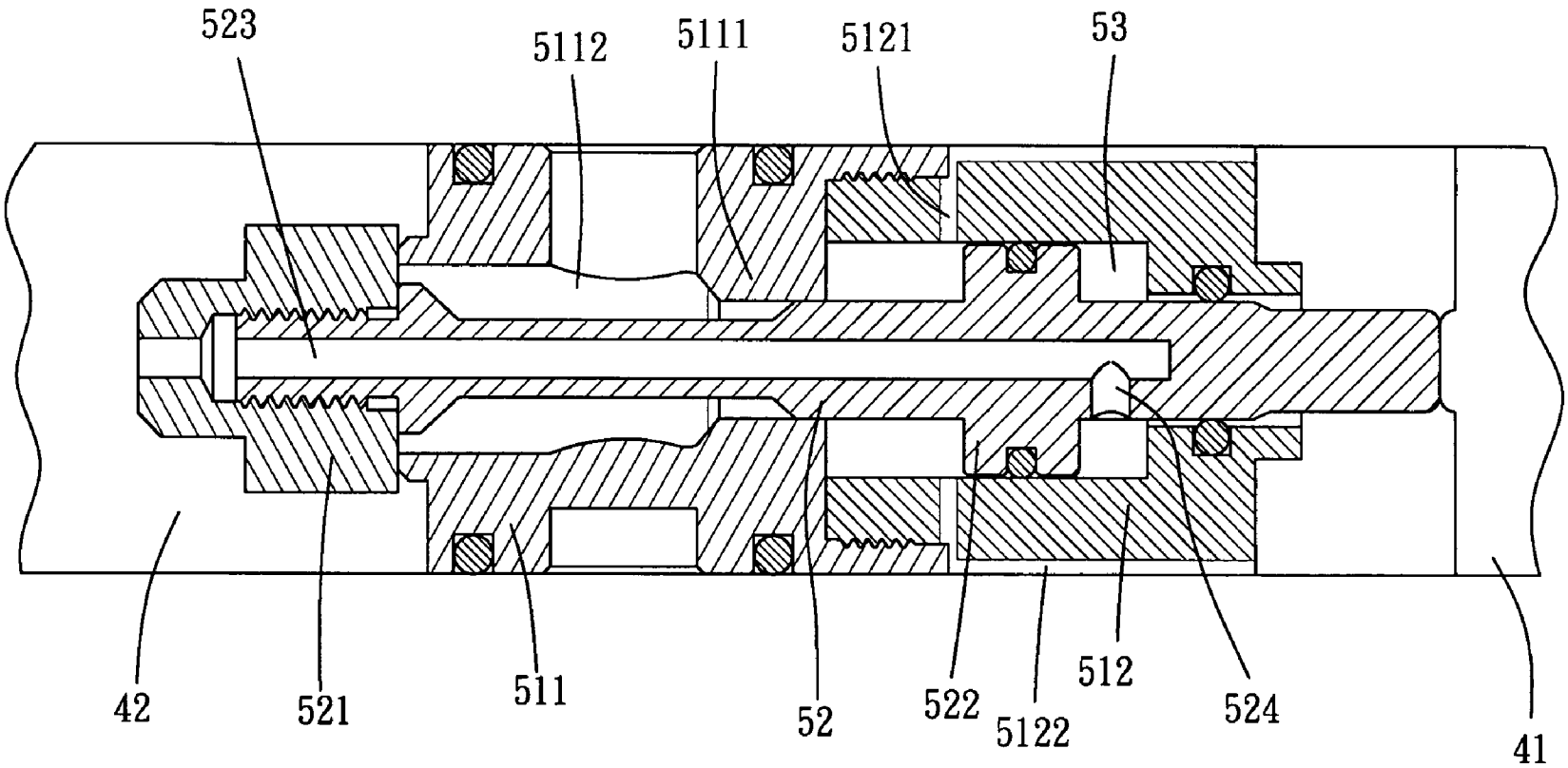
FIG. 3 is a cross sectional view to show the valve of the shooting mechanism of the present invention, wherein the piston rod is not yet be hit by the strike rod.
Figure 4:
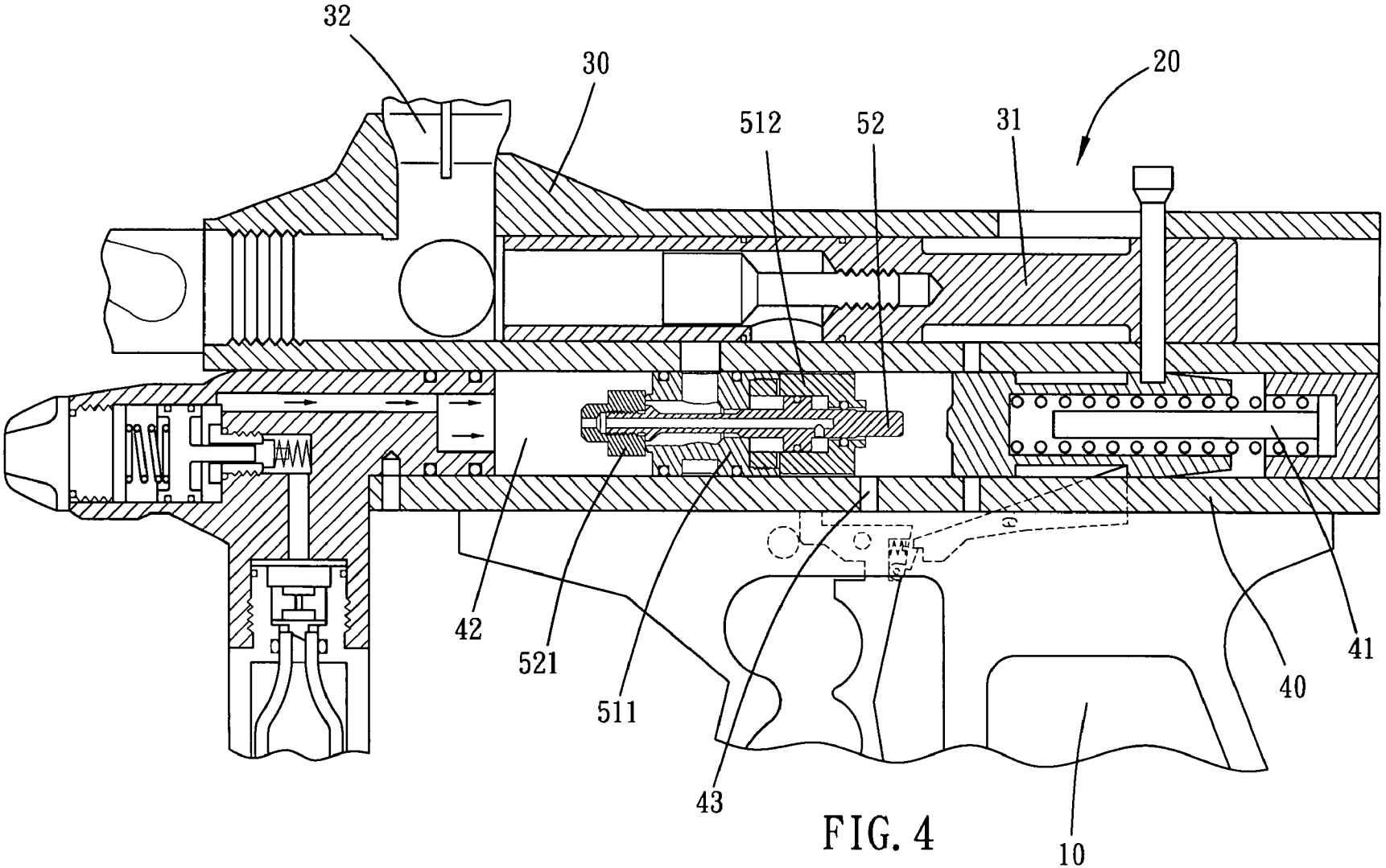
FIG. 4 is a cross sectional view to show the paint ball gun, wherein the piston rod is not yet be hit by the strike rod.

Referring to FIGS. 1 to 4, the paint ball gun 20 of the present invention comprises a handle 10 connected with a main body which includes an air tube 40 connected with the handle 10 and a shoot tube 30 located parallel to the air tube 40. A trigger unit is connected to the air tube 40 and a pressurized air source such as a pressurized air bottle can be connected to the air tube 40 so as to provide pressurized air into the air tube 40. A communication hole 21 is defined in communication between the shoot tube 30 and the air tube 40, the pressurized air from the pressurized air bottle can be introduced into the shoot tube 30 via the communication hole 21. A hopper 32 is connected to the shoot tube 30 and feeds paint balls in the shoot tube 30. A push member 31 is movably located in the shoot tube 30 and connected with a strike rod 41 which is movably received in a rear end of the air tube 40. When pulling the trigger unit, the strike rod 41 is released from the spring which provides a force to the strike rod 41 which moves at high speed toward a valve 50 which will be described later. The push member 31 then co-moved with the strike rod 41 to drive the paint ball out from the barrel connected to the shoot tube 30. The air tube 40 includes an escape hole 43 defined a wall thereof and the escape hole 43 is located between the second member 512 of the valve 50 and the strike rod 41. The escape hole 43 helps the pressure in the air tube 40 to release when operating the paint ball gun.

A first chamber 42 is defined in a front end of the air tube 40 and the pressurized air from the bottle is provided into the first chamber 42. The valve 50 is located in the air tube 40 and includes a first member 511 and a second member 512 which is threadedly connected to an end of the first member 511. A piston rod 52 movably extends through the valve 50. The first member 511 includes a space 5112 defined therein and a shoulder 5111 extends radially and inward from an inner periphery of the first member 511. The shoulder 5111 is located close to a threaded connection position between the first and second members 511, 512. An aperture is defined through a wall of the first member 511 and in communication between the shoot tube 30 and the space 5112. The second member 512 includes a plurality of radial holes 5121 defined through a wall thereof and communicate with grooves 5122 defined axially in an outer periphery of the second member 512.

Two ends of the piston rod 52 extend out from the first and second members 511, 512 respectively. A piston head 521 is threadedly connected to an end of the piston rod 52 and removably contacts an end of the first member 511 so as to seal the space 5112. The other end of the piston rod 52 extends out from the second member 512 and faces the strike rod 41. A flange 522 extends radially outward from the piston rod 52 and is located between the shoulder 5111 and an inner end of the second member 512. A cross sectional area of the piston head 521 is larger than a cross sectional area of the flange 522, so that the pressurized air applies a larger force to the piston head 521 than to the flange 522. A second chamber 53 is defined between the flange 522 and the inner end of the second member 512. A path 523 is defined axially in the piston rod 52 and communicates with the piston head 521 so as to introduce pressurized air from the first chamber 42 into the second chamber 53. The flange 522 can be stopped by the shoulder 5111 of the first member 511 when the strike rod 41 hits the piston rod 52. A side hole 524 is defined through a wall of the piston rod 52 and communicates with the path 523 and the second chamber 523.

Figure 5:
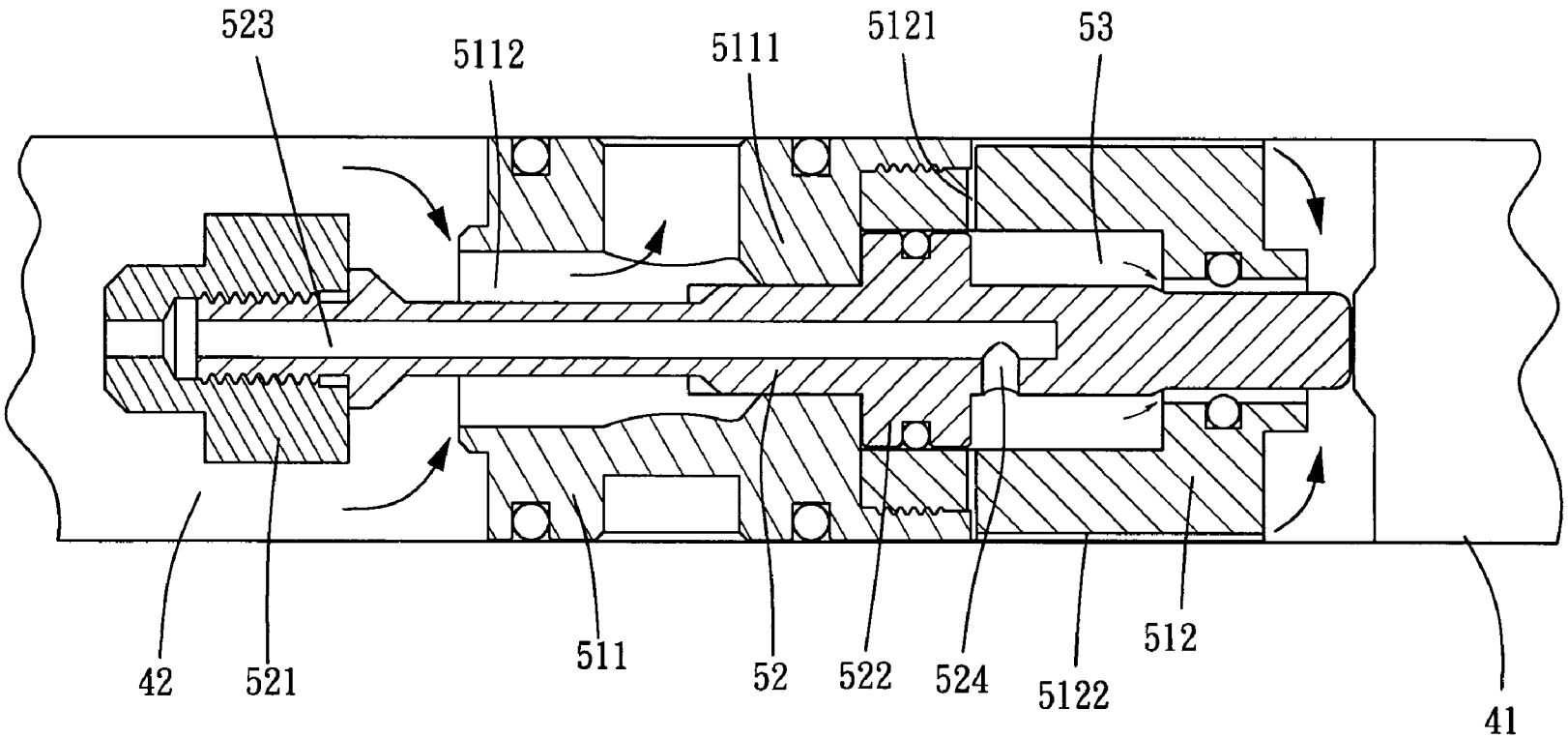
FIG. 5 is a cross sectional view to show the valve of the shooting mechanism of the present invention, wherein the piston rod is hit by the strike rod and the path that the pressurized air flows is shown by arrow heads.
Figure 6:
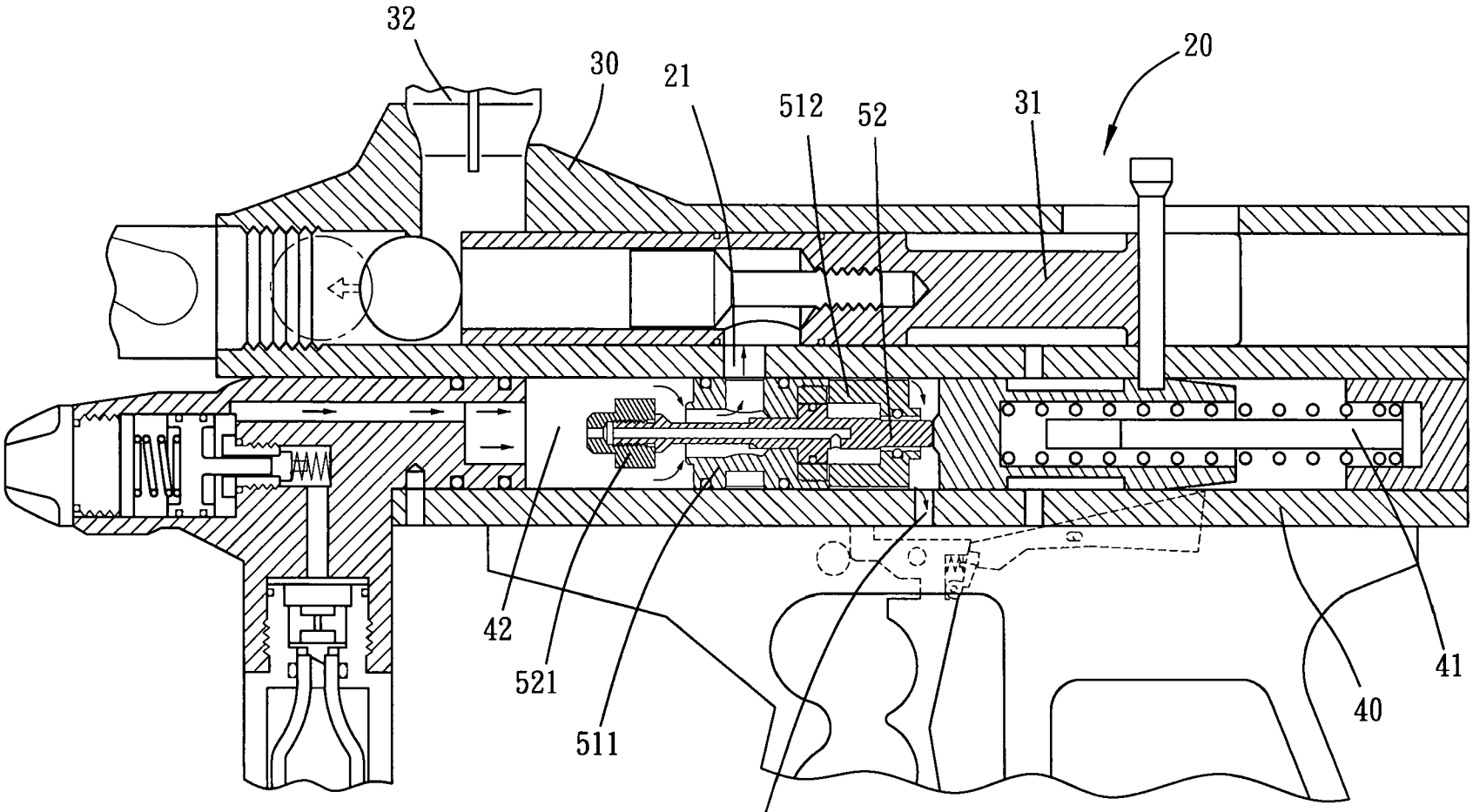
FIG. 6 is a cross sectional view to show the paint ball gun, wherein the piston rod is hit by the strike rod and the paint ball is pushed by the push member.

As shown in FIGS. 5 and 6, when pulling the trigger unit, the strike rod 41 hits the piston rod 52, the piston rod 52 moves until the flange 522 is stopped by the flange 5111. The pressure in the second chamber 53 also distributes a push force to the piston rod 52 such that the strike rod 41 does not need to apply too much force to the piston rod 52 so as to reduce the reaction force to the user. The piston head 521 is disengaged from the first member 511 such that the pressurized air in the first chamber 42 enters the first member 511 and enters into the shoot tube 30 via the communication hole 21 to push the paint ball in the shoot tube 30.

When the piston rod 52 moves backward to its original position, the second member 512 of the valve 50 has radial holes 5121 and grooves 5122 to release the air in the second chamber 53 in the second member 512 of the valve 50 when the piston rod moves back to its original position. The air is then released from the escape hole 43.

While we have shown and described the embodiment in accordance with the present invention, it should be clear to those skilled in the art that further embodiments may be made without departing from the scope of the present invention.

What is claimed is:

1. A paint ball gun comprising:

a handle connected with a main body which includes an air tube connected with the handle and a shoot tube located parallel to the air tube, a communication hole defined in communication between the shoot tube and the air tube, a hopper connected to the shoot tube and being adapted to feed paint balls in the shoot tube, a push member movably located in the shoot tube, a strike rod movably received in a rear end of the air tube and connected with the push member, a first chamber defined in a front end of the air tube and pressurized air being provided into the first chamber from a pressurized source, and a valve located in the air tube and including a first member and a second member which is threadedly connected to an end of the first member, a piston rod movably extending through the valve, the first member including a space defined therein and a shoulder extending radially and inward from an inner periphery of the first member, an aperture defined through a wall of the first member and being in communication between the shoot tube and the space, two ends of the piston rod extending out from the first and second members respectively, a piston head connected to an end of the piston rod and removably contacting an end of the first member so as to seal the space, the other end of the piston rod extending out from the second member and facing the strike rod, a flange extending radially outward from the piston rod and located between the shoulder and an inner end of the second member, a second chamber defined between the flange and the inner end of the second member, a path defined axially in the piston rod and communicating with the piston head so as to introduce pressurized air from the first chamber into the second chamber, the flange being stopped by the shoulder of the first member;

wherein the second member includes a plurality of radial holes defined through a wall thereof and communicating with grooves defined axially in an outer periphery of the second member.

2. The gun as claimed in claim 1, wherein a side hole is defined through a wall of the piston rod and communicates with the path and the second chamber.

3. The gun as claimed in claim 1, wherein the piston head is threadedly connected to the piston end.

4. The gun as claimed in claim 1, wherein the air tube includes an escape hole defined a wall thereof and the escape hole is located between the second member of the valve and the strike rod.

5. The gun as claimed in claim 1, wherein the shoulder is located close to a threaded connection position between the first and second members.

6. The gun as claimed in claim 1, wherein a cross sectional area of the piston head is larger than a cross sectional area of the flange.

* * * * *